United States Patent [19]

Laske

[11] Patent Number: 4,827,390

[45] Date of Patent: May 2, 1989

[54] ADJUSTABLE LAMP

[76] Inventor: Lawrence L. Laske, 1000 Springhaven Dr., Libertyville, Ill. 60048

[21] Appl. No.: 139,617

[22] Filed: Dec. 30, 1987

[51] Int. Cl.[4] ..... F21S 1/00

[52] U.S. Cl. ..... 362/427; 362/287; 362/418

[58] Field of Search ..... 362/285, 287, 418, 427, 362/33, 371, 426, 431

[56] References Cited

U.S. PATENT DOCUMENTS

| | | | |
|---|---|---|---|
| 1,781,372 | 11/1930 | Denecke | 362/427 X |
| 2,740,039 | 3/1956 | Phillips | 362/427 X |
| 3,409,767 | 11/1968 | Entwistle . | |
| 3,413,459 | 11/1968 | Sonneman . | |
| 4,314,319 | 2/1982 | Terry et al. | 362/427 X |

OTHER PUBLICATIONS

Catalogue Recapitulatif, Stilnovo, Milano, Italy, Apr. 1984, Particularly at p. 3, Catalog No. 32022, 32012, 12011/2/3.

*Primary Examiner*—Stephen F. Husar
*Attorney, Agent, or Firm*—Thomas W. Speckman

[57] ABSTRACT

An adjustable lamp having a lamp bar with a lamp attached at one end and an opposite pivot end pivotally attached to a base providing generally vertical pivotal movement of the lamp bar and a support structure supporting the lamp bar at a support point thereon between the lamp end and the pivot end, the support point being vertically placed to provide desired lamp vertical positioning.

19 Claims, 2 Drawing Sheets

ADJUSTABLE LAMP

BACKGROUND OF THE INVENTION

1. Field of the Invention

This invention relates to a vertically adjustable lamp of the type having a light attached to one end of a lamp bar, movement of the lamp bar providing desired vertical position for the light. In the adjustable lamp of the present invention, the lamp bar pivots relative to a base at the end opposite to the light providing generally vertical pivotal movement of the lamp bar and a support means is provided supporting the lamp bar at a support point between the pivot end and the end carrying the light to provide desired vertical positioning of the lamp.

2. Description of the Prior Art

A wide variety of adjustable lamps are known which provide a light fixture at the end of a bar-type structure. A large number of such lamps have the pivot point in a central position on the bar structure so as to provide a counterpoise effect as illustrated by U.S. Pat. No. 3,413,459 and in Catalogue Recapitulatif, Stilnovo, Milano, Italy, April 1984, particularly at page 3, Catalog No. 32022, 32012, 12011/2/3. A double counterbalanced arm system is taught by U.S. Pat. No. 3,409,767. It is also known to provide "gooseneck" lamp arms which are constructed of flexible material and may be bent to retain their shape at the desired positioning. Lamp arms which are rotatable about a pivot point and require adjustment of the pivot position by loosening or tightening the pivot mechanism are also known to the art.

SUMMARY OF THE INVENTION

The present invention is directed to a vertically adjustable lamp with a light attached to one end of a lamp bar and the opposite end of the lamp bar attached to a freely movable pivot assembly attached to a lamp base providing generally vertical pivotal movement of the lamp bar. A support means supports the lamp bar at a support point on said lamp bar between the lamp end and the pivot end and vertically places the support point of the lamp bar to provide the desired lamp vertical position. In one embodiment, the lamp bar pivot assembly is fixedly attached to the base, while in another embodiment, the lamp bar pivot assembly is attached to the base by vertically adjustable attachment. In either embodiment, the lamp bar freely pivots by a generally vertical pivotal movement of the lamp bar about the pivot assembly at one end of the lamp bar and is supported in desired vertical position by a support means supporting the lamp bar at a support point spaced between the lamp end and the pivot end of the lamp bar to maintain the lamp at a desired vertical position.

In one embodiment, the lamp bar support is adjustably engageable in a plurality of generally vertically arranged holding mechanisms on a generally vertical portion of the base. The holding mechanisms may comprise a series of holes, notches, or any other structure to hold the lamp bar support.

In another embodiment, the lamp bar support may be in the form of an upstanding adjustment bar arm pivotally attached to the base at its lower end with its other end contacting the lamp bar at its intermediate support point, pivotal movement of the adjustment bar raising and lowering the lamp bar which pivots about the lamp bar pivot means at the end of the lamp bar attached to the base structure.

In another embodiment, lamp bar support may be furnished by a fixed upstanding support bar attached to the base at its lower end and providing support to the support point of the lamp bar at its other end with generally vertical pivotal adjustment of the lamp bar being achieved by vertical movement of the lamp bar pivot assembly with respect to the base. Lamp bar pivot assembly vertical adjustment may be achieved in generally the same fashions as above described for vertical adjustment of the support for the lamp bar.

BRIEF DESCRIPTION OF THE DRAWING

The above objects and advantages of this invention are described in preferred embodiments and shown in the drawing wherein.

DESCRIPTION OF PREFERRED EMBODIMENTS

Figure 1:
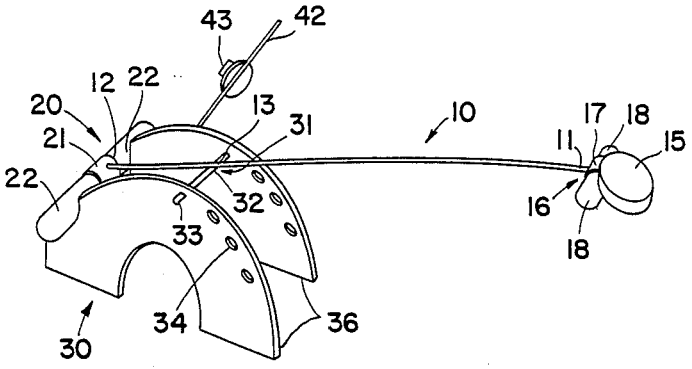
FIG. 1 is a perspective view of one embodiment of an adjustable lamp according to this invention having a lamp bar pivot fixedly attached to the base and generally vertically adjustable support mating with generally vertical arches of the base.

FIG. 1 shows one embodiment of an adjustable lamp of this invention having base 30 comprised of two generally vertical uprights 36. Lamp bar 10 has lamp end 11 and pivot end 12 with support point 13 therebetween. Lamp bar 10 may be constructed of any generally rigid material such as metal such as brass or steel, or of a synthetic polymer material such as nylon or fiberglass. Lamp bar 10 may preferably be tubular-shaped, round or polygonal, or may be of a channel or angular shape to provide concealed carrying of electrical wires for its length to provide electricity to the light at its lamp end. Any suitable illuminating lamp 15 may be mounted on lamp end 11 of lamp bar 10. Illuminating lamp 15 may be of any suitable illuminating type known to the art, such as a high intensity lamp. Illuminating lamp 15 may be fixedly attached to lamp end 11 of lamp bar 10 or may preferably be attached by lamp pivot and/or swivel means 16 providing a fixed portion 17 and a pivot or swivel portion 18 for fixed attachment to illuminating lamp 15 by a wide variety of means well known to the art.

Figure 3:
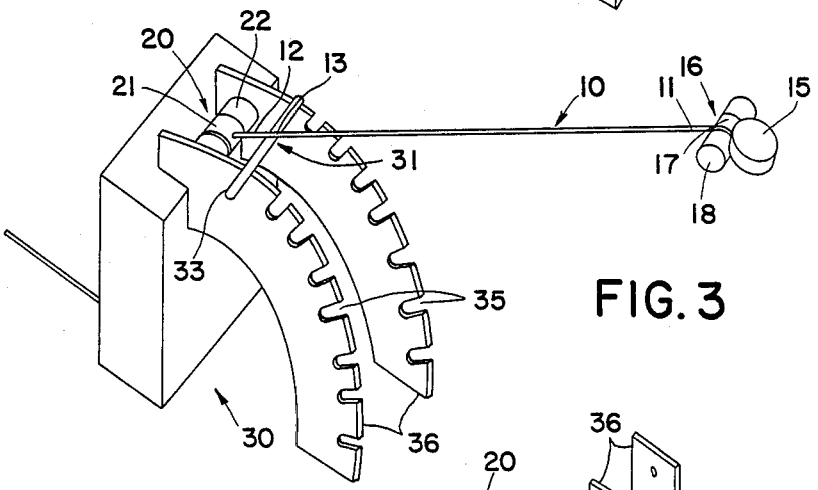
FIG. 3 is a perspective view of another embodiment of this invention having a generally vertical base portion and a lamp bar pivot fixedly attached to the base portion and generally vertical adjustable support mating with generally vertical partial arcuate sections of the base.

Lamp bar pivot means 20 has central pivot portion 21 attached to pivot end 12 of lamp bar 10 and is freely pivotable about end fixed portions 22 which are fixed to vertical uprights 36 of base 30. In another embodiment pivot end 12 may be split into two lateral portions attached to spaced pivot portions which are freely pivotable about a central fixed portion fixed to the base. Support means in this embodiment comprise adjustment bar 31 having support portion 32 for support of lamp bar 10 at support point 13 and positioning portions 33 for vertical adjustment in base holding means, shown in FIG. 1 as holes 34. Adjustment bar 31 may be provided as any sufficiently rigid material such as metals or synthetic polymers, and may be of any suitable shape to mate with a generally vertically arranged plurality of base holding means which may be in the form of notches 35 as shown in FIG. 3, holes 34 as shown in FIG. 1, or any other type of generally vertically arranged holding means. It is thus seen that as shown in FIG. 1, illuminating lamp 15 is in its highest vertically adjustable position and may be lowered by placement of adjustment bar 31 in any of the lower generally vertically arranged holes 34. Illuminating lamp 15 may be pivoted to an out-of-the way position simply by lifting lamp end 11 of lamp bar 10 thereby pivoting central pivot portion 21 of lamp bar pivot means 20 to a desired upright or laid back position against a stop means acting upon central pivot portion 21 with return of illuminating lamp 15 to its identical illuminating position by pivoting forwardly so that support point 13 of lamp bar 10 against rests upon adjustment bar 31.

Electrical wiring of the adjustable lamp of this invention is not a part of this invention and may be achieved by any means known to the art, such as by electric supply cord 42 which may have an in-line switch 43 and may feed electricity to illuminating lamp 15 through central pivot portion 21 of lamp bar pivot means 20 and lamp bar 10 by means well known to the art.

Figure 2:
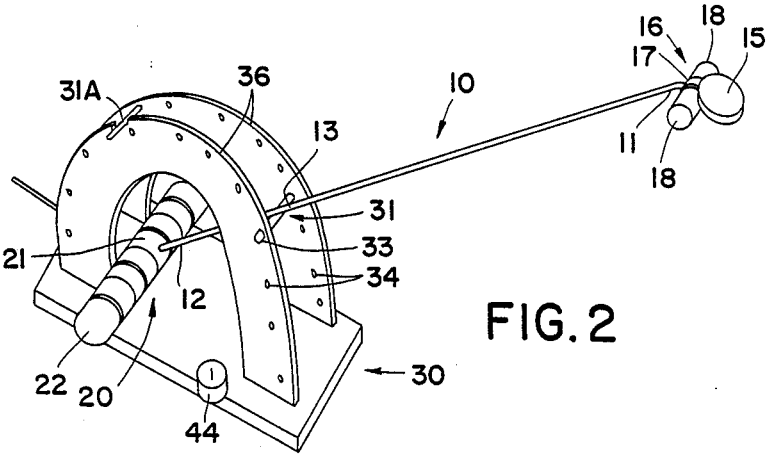
FIG. 2 is a perspective view of another embodiment of an adjustable lamp having a lamp bar pivot fixedly attached to a flat base portion and a generally vertically adjustable support mating with generally vertical arches of the base.

FIG. 2 shows another embodiment of the adjustable lamp of this invention wherein base 30 has a flat portion with two generally vertical upstanding arch portions 36. Lamp bar pivot means 20 is fixedly attached to the flat base portion and adjustment bar 31 placed in desired vertically arranged holes 34 to hold lamp bar 10 in the desired vertical position. The embodiment shown in FIG. 2 is particularly suited for placement of an adjustment bar 31A in second set of holes 34 in vertical uprights 36 to provide a fixed second position or laid back position for lamp bar 10. Also in the embodiment shown in FIG. 2, electrical switch 44 is shown on the flat plate portion of base 30. In other manners, the embodiment of the adjustable lamp shown in FIG. 2 operates in the same fashion as described with respect to FIG. 1, the same numerals in all figures of the drawing relate to the same part functioning in the same manner as described.

The embodiment shown in FIG. 3 has a vertical plate-like portion and two arcuate generally vertical uprights 36 to form base 30. An embodiment similar to that shown in FIG. 3 may have a horizontal plate-like portion which solely supports arcuate generally vertical uprights without the vertical plate-like portion as shown. Arcuate uprights 36 have slots 35 which function to vertically position adjustment bar 31. The embodiment shown in FIG. 3 is particularly useful when it is desired to have lamp bar 10 at a near horizontal or at an angle below horizontal. The form of the base 30 shown in FIG. 3 is especially useful when it is desired to hook the lamp on a vertical plate-like structure such as a bed headboard or the top of a high back chair by placing the headboard or other structure between the vertical plate-like portion and the two arcuate uprights of the base.

Figure 4:
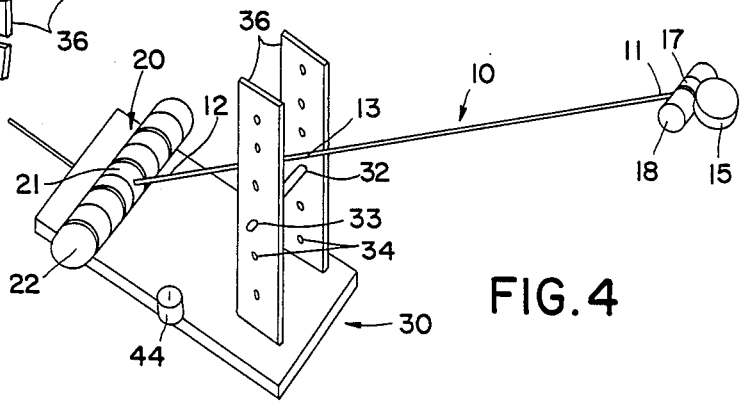
FIG. 4 is a perspective view of another embodiment of this invention having a lamp bar pivot fixedly attached to a flat base portion and generally vertically adjustable support mating with two uprights.

FIG. 4 shows an embodiment similar to that of FIG. 2 except that vertical uprights 36 are parallel flat plate structures aligned with lamp bar 10 passing about midway between them.

Figure 5:
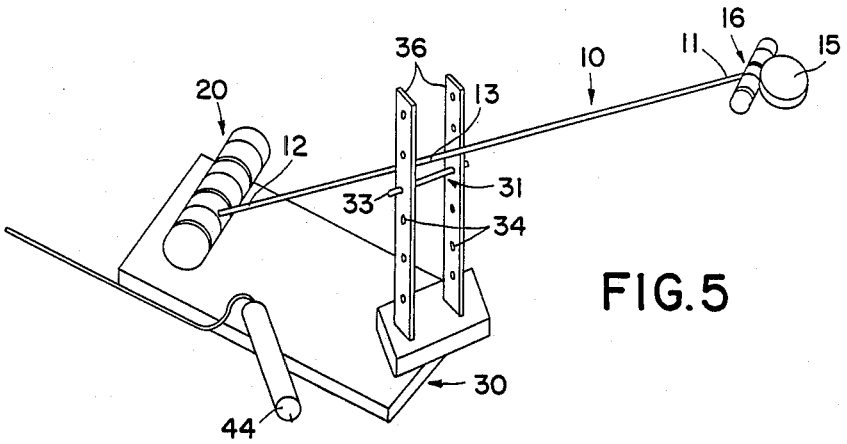
FIG. 5 is a perspective view of another embodiment of this invention similar to FIG. 4 except that the two uprights are not aligned with the lamp bar.

FIG. 5 shows another embodiment similar to the structure shown in FIG. 4 except lamp bar 10 is not aligned with vertical uprights 36 and passes between them at an angle.

Figure 6:
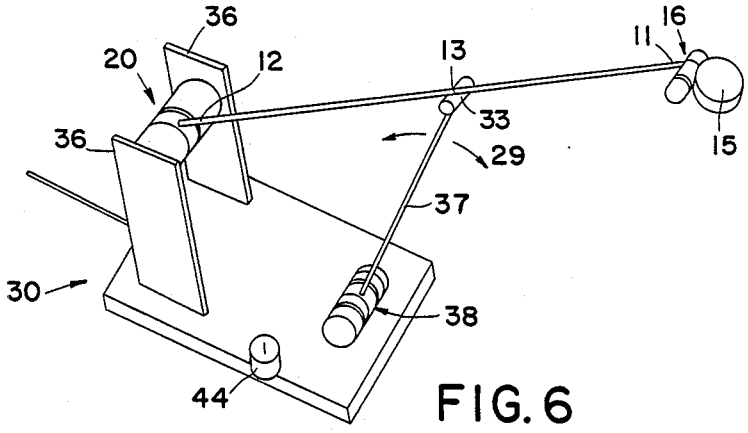
FIG. 6 is a perspective view of another embodiment of this invention having a lamp bar pivot fixedly attached to uprights extending from a flat base portion and an adjustable bar arm pivotally mounted by pivot means to the base at one end and the opposite end positioning the lamp bar by contact at the support point.

Another embodiment shown in FIG. 6 has base 30 comprised of a horizontal flat plate-like portion and vertical upright portions 36. In this embodiment, pivot end 12 of lamp bar 10 is pivotally attached to lamp bar pivot means 20 which is attached to upright portions 36 in a vertically non-adjustable manner. Support means comprises adjustment bar arm 37 which is attached to the horizontal flat portion of base 30 through pivot means 38 providing pivotal movement of adjustment bar arm 37 in the direction of arrows 29 to provide vertical adjustment of lamp bar 10 resting on positioning portion 33 at support point 13. It is readily apparent that adjustment bar arm 37 may extend above lamp arm 10 and positioning portion 33 may be a cross bar or any other extending structure upon which support point 13 may rest. It is recognized that with movement of adjustment bar arm 37 support point 13 will move along lamp bar 10.

Figure 7:
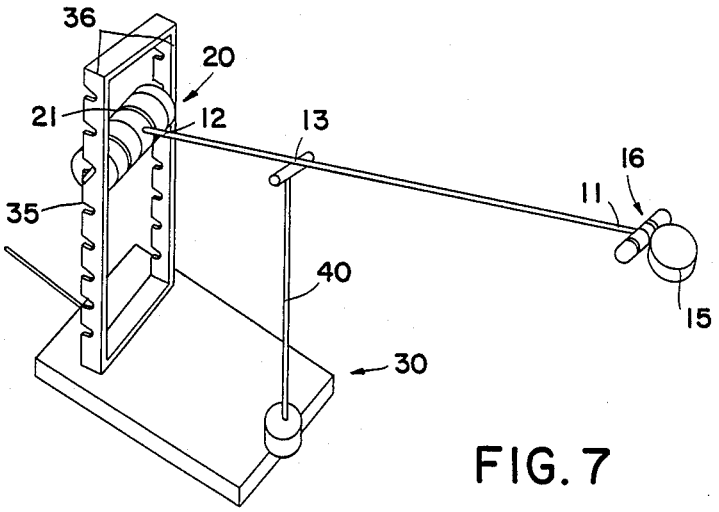
FIG. 7 is a perspective view of another embodiment of this invention having generally vertical adjustment of the pivot means at the pivot end of the lamp bar with a fixed support bar extending above the base and supporting the lamp bar at the support point.

FIG. 7 shows lamp bar pivot means 20 fixedly or pivotably attached to pivot end 12 of lamp arm 10 and vertically adjustable by placement in slots 35 of vertical uprights 36 of base 30. The end of pivot means 20 may be held in a fixed relation to upright portions 36 while an interior portion of pivot means 20 may pivot to provide movement of lamp arm 10. Electricity may be conducted by vertical uprights 36 to lamp arm 10 through pivot means 20 by various means known to the art, such as by a conducting pin passing through a hole in vertical upright 36 to complete electrical contact and to position pivot means 20. Pivotal action is obtained by rotary movement of pivot means 20 with respect to vertical uprights 36. Support means in this embodiment comprises fixed support bar 40 which is attached to base 30 at one end and provides support to support point 13 of lamp bar 10 to provide desired vertical height of lamp 15 by movement of pivot means 20 to corresponding slots 35.

It is seen from the description of specific embodiments tat an adjustable lamp of this invention has a lamp bar with a lamp end and an opposite pivot end with a support point therebetween. A lamp bar pivot means is attached to the pivot end of the lamp bar and to a base in a manner to provide generally vertical pivotal movement of the lamp bar. The pivot means may be vertically fixedly attached to the base or may be vertically adjustably attached to the base. Support means are attached to the base to support the lamp bar at the support point to provide desired lamp vertical positioning. The support means may be vertically fixedly attached to the base or may be vertically adjustably attached to the base, provided that at least one of the lamp bar pivot means and the support means is vertically adjustably attached to the base. Both the lamp bar pivot means and the support means may be vertically adjustably attached to the base. It is readily apparent that a wide variety of specific structures may be used to construct the components of the adjustable lamp of this invention as long as the above described relations of the components are observed.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An adjustable lamp comprising: a base, a lamp bar having a lamp end, an opposite pivot end, and a support point therebetween; a lighting means attached to said lamp end; a lamp bar pivot means fixedly attached to both said opposite pivot end and said base, said lamp bar pivot means providing solely pivotal movement of said lamp bar generally within a vertical plane; and support means attached to said base supporting said lamp bar at said support point to provide desired lamp vertical position.

2. An adjustable lamp according to claim 1 wherein said support means comprises an adjustment bar having a support portion in contact with said lamp bar at said support point and a base positioning portion adjustably engageable in at least one of a plurality of generally vertically arranged holding means on a generally vertical portion of said base.

3. An adjustable lamp according to claim 1 wherein said support means comprises an upstanding adjustment bar arm pivotally attached to said base at its lower end and having an adjustment bar at its opposite upper end having a support portion in contact with said lamp bar at said support point, pivotal movement of said adjustment bar arm raising and lowering said lamp bar pivoting about said lamp bar pivot means.

4. An adjustable lamp according to claim 3 wherein said lamp bar pivot means is attached to said base at a vertically higher position than said upstanding adjustment bar arm is pivotally attached to said base.

5. An adjustable lamp according to claim 1 wherein said lamp bar pivot means is attached to said base by vertically adjustable attachment means.

6. An adjustable lamp according to claim 5 wherein said lamp bar pivot means has a base holding portion adjustably engageable in at least one of a plurality of generally vertically arranged holding means of a generally vertical portion of said base.

7. An adjustable lamp according to claim 6 wherein said generally vertical portion of said base comprises two generally vertical uprights and said holding means comprise matching openings in said uprights in which said base holding portion of said lamp bar pivot means is removably engageable.

8. An adjustable lamp according to claim 7 wherein said support means comprises a fixed upstanding support bar.

9. An adjustable lamp according to claim 5 wherein said support means comprises a fixed upstanding support bar.

10. In an adjustable lamp of the type having a base and a lamp bar having a light means attached to its free end, the improvement for vertical adjustment of said lamp comprising: said lamp bar having a lamp bar pivot means fixedly attached to both an opposite end of said lamp bar and said base, said lamp bar pivot means providing solely pivotal movement of said lamp bar generally within a vertical plane; and support means attached to said base supporting said lamp bar at said support point to provide desired lamp vertical position.

11. In an adjustable lamp according to claim 10 wherein said support means comprises an adjustment bar having a support portion in contact with said lamp bar at said support point and a base positioning portion adjustably engageable in at least one of a plurality of generally vertically arranged holding means on a generally vertical portion of said base.

12. In an adjustable lamp according to claim 10 wherein said support means comprises an upstanding adjustment bar arm pivotally attached to said base at its lower end and having an adjustment bar at its opposite upper end having a support portion in contact with said lamp bar at said support point, pivotal movement of said adjustment bar arm raising and lowering said lamp bar pivoting about said lamp bar pivot means.

13. In an adjustable lamp according to claim 12 wherein said lamp bar pivot means is attached to said base at a vertically higher position than said upstanding adjustment bar arm is pivotally attached to said base.

14. In an adjustable lamp according to claim 10 wherein said lamp bar pivot means is attached to said base by vertically adjustable attachment means.

15. In an adjustable lamp according to claim 14 wherein said lamp bar pivot means has a base holding portion adjustably engageable in at least one of a plurality of generally vertically arranged holding means of a generally vertical portion of said base.

16. In an adjustable lamp according to claim 15 wherein said generally vertical portion of said base comprises two generally vertical uprights and said holding means comprise matching openings in said uprights in which said base holding portion of said lamp bar pivot means is removably engageable.

17. In an adjustable lamp according to claim 10 wherein said support means comprises a fixed upstanding support bar.

18. An adjustable lamp comprising: a base; a lamp bar having a lamp end, an opposite pivot end, and a support point therebetween; a lighting means attached to said lamp end; a lamp bar pivot means attached to said opposite pivot end, said lamp bar pivot means fixedly attached to said base providing generally vertical pivotal movement of said lamp bar; support means attached to said base supporting said lamp bar at said support point to provide desired lamp vertical position;

said support means further comprising an adjustment bar having a support portion in contact with said lamp bar at said support point and a base positioning portion adjustably engageable in at least one of a plurality of generally vertically arranged holding means on a generally vertical portion of said base; and said generally vertical portion of said base further comprising two generally vertical uprights and said holding means further comprising openings in said uprights in which said positioning portion of said adjustment bar is removably engageable.

19. In an adjustable lamp of the type having a base and a lamp bar having a light means attached to its free end, the improvement for vertical adjustment of said lamp comprising: said lamp bar having a lamp bar pivot means attached to its opposite end, said lamp bar pivot means fixedly attached to said base providing generally vertical pivotal movement of said lamp bar; support means attached to said base supporting said lamp bar at said support point to provide said lamp vertical position;

said support means further comprising an adjustment bar having a support portion in contact with said lamp bar at said support point and a base positioning portion adjustably engageable in at least one of a plurality of generally vertically arranged holding means on a generally vertical portion of said base; and said generally vertical portion of said base further comprising two generally vertical uprights and said holding means further comprising openings in said uprights in which said positioning portion of said adjustment bar is removably engageable.

* * * * *